US005495981A

United States Patent [19]

Warther

[11] Patent Number: 5,495,981

[45] Date of Patent: Mar. 5, 1996

[54] TRANSACTION CARD MAILER AND METHOD OF MAKING

[76] Inventor: Richard O. Warther, 25 Sheffield La., West Chester, Pa. 19380

[21] Appl. No.: 191,975

[22] Filed: Feb. 4, 1994

[63] Continuation-in-part of Ser. No. 620,236, Nov. 29, 1990, Pat. No. 5,180,824, which is a continuation-in-part of Ser. No. 502,005, Mar. 30, 1990, Pat. No. 4,978,146.

[51] Int. Cl.[6] ..... B65D 27/04; B42D 15/00

[52] U.S. Cl. ..... 229/71; 229/92.3; 229/92.8; 283/81; 283/904

[58] Field of Search ..... 229/70, 71, 92.1, 229/92.3, 92.8; 283/81, 904

[56] References Cited

U.S. PATENT DOCUMENTS

| | | | |
|---|---|---|---|
| 1,795,291 | 3/1931 | Dunn . | |
| 1,957,374 | 5/1934 | Unger | 229/92.8 X |
| 2,312,204 | 2/1943 | Weindel, Jr. . | |
| 2,357,641 | 9/1944 | Evalt . | |
| 2,616,612 | 11/1952 | Guttman . | |
| 2,812,601 | 11/1957 | Hines . | |
| 3,062,431 | 11/1962 | Rabenold | 229/92.8 X |
| 3,068,140 | 12/1962 | Biddle . | |
| 3,093,296 | 6/1963 | Wood | 229/92.8 |
| 3,140,818 | 7/1964 | Sheldon | 229/92.8 |
| 3,152,901 | 10/1964 | Johnson . | |
| 3,583,317 | 6/1971 | Gibson . | |
| 3,674,622 | 7/1972 | Plasse . | |
| 3,676,644 | 7/1972 | Vaccaro et al. . | |
| 3,679,448 | 7/1972 | Tramposch . | |
| 3,679,449 | 7/1972 | Nagot et al. . | |
| 3,716,439 | 2/1973 | Maeda . | |
| 3,716,440 | 2/1973 | Ando et al. . | |
| 3,808,718 | 5/1974 | Christiansen . | |
| 3,999,700 | 12/1976 | Chalmers . | |
| 4,006,050 | 2/1977 | Hurst et al. . | |
| 4,149,305 | 4/1979 | Blumhof . | |
| 4,214,463 | 7/1980 | Blumhof . | |
| 4,271,352 | 6/1981 | Thomas . | |
| 4,306,433 | 12/1981 | Kelly . | |
| 4,425,772 | 1/1984 | Brewer . | |
| 4,521,981 | 6/1985 | Kasprzycki et al. . | |
| 4,523,088 | 6/1985 | Utsch et al. . | |
| 4,589,687 | 5/1986 | Hannon . | |
| 4,630,067 | 12/1986 | Teraoka . | |
| 4,641,347 | 2/1987 | Clark et al. . | |
| 4,653,775 | 3/1987 | Raphael et al. . | |
| 4,712,929 | 12/1987 | Kitaoka . | |
| 4,842,304 | 6/1989 | Jones . | |
| 4,887,763 | 12/1989 | Sano . | |
| 4,978,146 | 12/1990 | Warther et al. . | |

*Primary Examiner*—Allan N. Shoap
*Assistant Examiner*—Jes F. Pascua
*Attorney, Agent, or Firm*—Panitch Schwarze Jacobs & Nadel

[57] ABSTRACT

A printed sheet product comprises a thin core having a pair of opposing major planar sides. A plurality of sets of variable data fields are printed on at least a first side of the core. One or more of the variable data fields of each set may be printed on the opposing second side of the core. Each set of printed variable data fields includes at least a first data field printed with a numeric code, the numeric code of each variable data field set being different from that of each other set printed on the first side of the core. Each set of variable data fields further includes a second data field printed with either a name and mailing address uniquely associated with a numeric code or with another representation of the numeric code. Where printed, the name and address of each variable data set differs from that of each other variable data set printed on the first side of the core. The sheet product is scored to at least define one removable element containing the first variable data field from each set printed on the sheet product. Where name and address data fields are printed, the sheet product may further be scored to separate the sheet product into individual sheet sections which can be inserted without folding into envelopes for direct mailing of the removable first element to an appropriate recipient.

20 Claims, 6 Drawing Sheets

TRANSACTION CARD MAILER AND METHOD OF MAKING

FIELD OF THE INVENTION

The invention relates to mailers and sheet products for use as parts of mailers and, in particular, to sets of uniquely encoded transaction cards, tags, labels and other sheet elements used in mailers.

BACKGROUND OF THE INVENTION

A substantial market has developed in recent years for inexpensively manufactured, individually encoded, transaction cards for such uses as store credit cards, membership cards, I.D. cards, etc. The transaction cards typically bear the code in a bar format to permit automatic machine scanning of the card. Such cards typically are supplied in sets with one or more labels, tags, etc. being supplied with each card and bearing the same individual code number as the card for attachment to application forms, membership lists, etc.

Previously, it has taken many separate manufacturing steps to provide such sets. Perhaps the most efficient prior method has been printing in multiple steps, individual sheets of uniquely encoded, typically sequentially numbered, transaction cards, printing separate strips of release paper back adhesive labels with the same, unique codes as the cards, in the same sequence of codes as the codes appear on the cards of the sheets, and attaching the strip(s) with the appropriate code numbers to each sheet with the labels adjoining the like coded card(s).

In practice, this apparently simple, straightforward method requires several labor intensive steps. The appropriate labels for each sheet of cards must be identified and applied by hand to the sheet so that the labels properly adjoin the associated transaction cards. Because this correlation of the separate elements of each sheet is done by hand, considerable time and effort also must be spent in checking the final product to assure accuracy.

In addition, because the transaction card sheets and label strips must be printed separately, more time is needed to complete the task if the same printer is used to print the transaction card sheet and label strips. Alternatively, several printers must be available to simultaneously print the cards and the strips.

The present invention is directed to solving the twin problems of relatively high cost and errors associated with hand production of sets of plural related printed elements, all bearing some code unique to each set of elements, by eliminating hand collation and assembly of the separate elements into the sets as well as the material costs associated with such elements.

The present invention is also directed to solving the problem of the numerous printing steps which are currently required to produce related sets of card sheets and separate label strips, by reducing the number of required printing steps.

SUMMARY OF THE INVENTION

In one aspect, the invention is a transaction card mailer comprising: a generally rectangular envelope having a length and width and a front face with a window; and an integral transaction card/insert sheet section of generally rectangular configuration having length about the length of the envelope or less and a width about the width of the envelope or less, the sheet section being received in the envelope without folding, the sheet section being printed in a first data field with a unique code in a machine readable format and in a second, separate data field with a name and mailing address of an individual assigned the unique code, the second data field being located on the sheet section aligned with and visible through the window of the envelope, the sheet section including a generally rectangular shaped scoring extending at least sufficiently through the sheet section to define a generally rectangular card portion removable from a remainder of the sheet section, the card portion including at least the first data field with the unique code, the card portion having a given material composition and the remainder of the sheet section adjoining the scoring having a material composition identical to the material composition of the card portion.

In another aspect, the invention is a method of making a transaction card mailer comprising the steps of printing a plurality of sets of variable data fields on at least a first of a pair of opposing major planar sides of a thin core, each set of printed variable data fields including at least a first data field printed with a unique code in a machine readable format, the unique code of each variable data field set printed on at least the first side of the core being different from the unique code of each other set of variable data fields printed on the first side of the core, and each set of variable data fields including a second data field printed with a name and mailing address uniquely associated with the unique code of the set of printed variable data fields, the name and address of the second data field of each set being different from the name and address of the second data field of each other set of data fields printed on the core; scoring the core to divide the core into a plurality of individual, generally rectangular sheet sections and to further define at least one element in each sheet section removable from the sheet section, each sheet section containing a separate one of the plurality of said printed variable data fields, and one removable element of each sheet section containing at least the first variable data field of the one set of variable data fields printed on the sheet section; and inserting at least one of the sheet sections with at least the one removable element of the one sheet section still in the one sheet section into a generally rectangular envelope without folding the sheet section, the envelope having a window and the printed name and mailing address of the inserted sheet section being visible through the window.

BRIEF DESCRIPTION OF THE DRAWINGS

The foregoing summary, as well as the following detailed description of the presently preferred embodiments of the invention, will be better understood when read in conjunction with the appended drawings. It should be understood, however, that this invention is not limited to the precise arrangements illustrated. In the drawings.

DETAILED DESCRIPTION OF PREFERRED EMBODIMENTS

Figure 1:
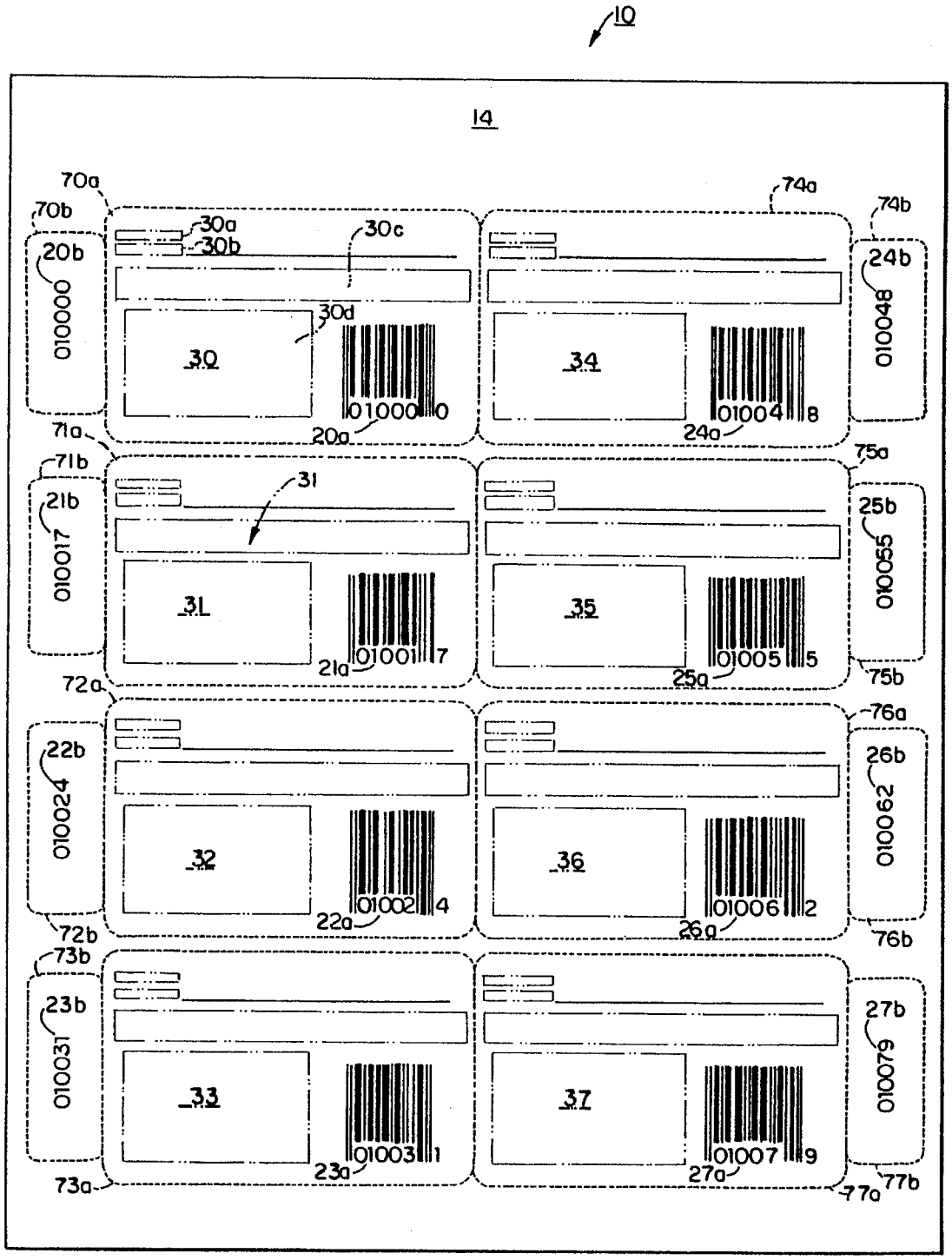
FIG. 1 depicts diagrammatically a first major planar side of a first printed sheet product of the invention.
Figure 2:
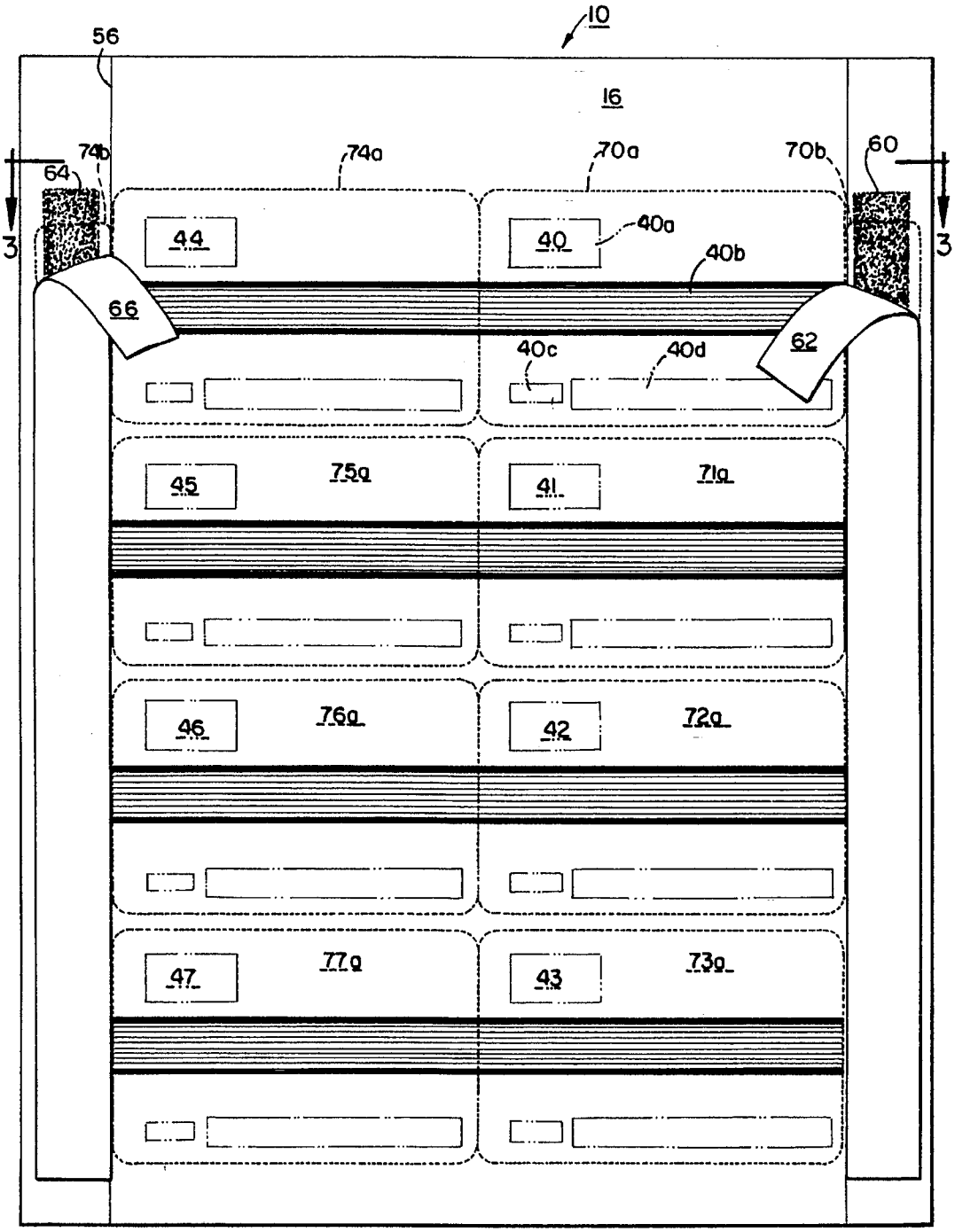
FIG. 2 depicts diagrammatically a second major planar side of the sheet product of FIG. 1.
Figure 3:
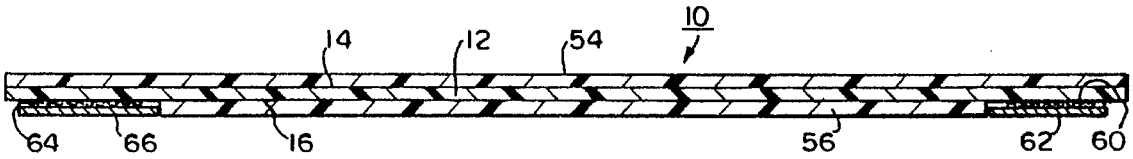
FIG. 3 depicts diagrammatically a cross section through the sheet products of FIGS. 1 and 2 along the lines 3—3.

FIGS. 1, 2 and 3 depict, in varying views, a first printed sheet product of the present invention indicated generally at 10. The product 10 includes a thin, flexible core 12 (see FIG. 3) which is, in this embodiment, the size of the product 10 depicted in FIGS. 1 and 2 and which has two major planar opposing sides 14 and 16. As will be seen, core sides 14 and 16 effectively form the imprinted sides of the product 10 as well. Side 14 is depicted in FIG. 1. Side 16 is depicted in FIG. 2.

Referring to FIG. 1, there is printed on the first major side 14 of the core 12, a plurality of sets of code fields. In the depicted product 10, eight code field sets of two code fields each are preferred but larger or smaller numbers of code field sets with equal or larger numbers of code are possible. A first code field of each of the eight code field sets is identified generally at 20*a* through 27*a*, respectively, while a second code field of each of the eight code field sets is indicated generally at 20*b* through 27*b*, respectively. Printed in each of the first code fields 20*a* through 27*a* and second code fields 20*b* through 27*b* are unique codes, examples of which are actually shown on FIG. 1. The code of each of the eight sets of code fields 20*a* and 20*b*, 21*a* and 21*b*, etc., is unique to the set and differs from the unique code of each of the remaining sets of fields printed on the first side 14 of the core 12. In the depicted example, each code has six decimal digits. The first five digits are sequential between 01000 and 01007. The sixth digit in each code is a check digit. The six digit codes are merely examples. More or fewer digits and even letters and other symbols can be incorporated into the codes, although it will be appreciated that letters and other symbols may not be usable in some code formats, for example, in some bar code formats. Also, although it is a preferred method of encoding, the unique codes need not be numerically sequential, merely uniquely identifiable.

The unique code of each set of code fields is printed in at least a machine readable format and, preferably, in both machine readable bar and machine and human readable numeral formats in the first code field 20*a* through 27*a*, respectively, of each of the eight sets of code fields. The same unique code of the set preferably is printed in at least numeral format in the second code field 20*b* through 27*b* of each set of code fields as indicated. The second code field 20*b* through 27*b* of each code field set is spaced from the first code field of the set, 20*a* through 27*a*, respectively, on the first side 14 of the core 12 and the sheet product 10.

Also printed on the first side 14 of the core 12 are a first plurality of static graphic fields, represented by various dot and dashed blocks, indicated collectively at 30 through 37, respectively. Such fields typically contain text and/or graphic designs. In the embodiment being depicted, each static graphic field has four separate components, numbered individually for a first of the fields 30 as 30*a*, 30*b*, 30*c*, 30*d*. The numbers and locations of the components of the static graphic fields are not significant per se to the invention. The static graphic fields 30–37 are usually identical to one another, but need not be so. Preferably, the number of static graphic fields 30–37 printed is at least equal the number of sets of code fields, in this case eight, whereby one of the static graphic fields 30–37 is associated with a separate one of the code field sets. One of the code fields of each of the sets of code fields is positioned substantially identically with respect to one of the static graphic fields 30–37. In this case, the first code field 20*a*–27*a* of each set of code fields is located in the same position with respect to each of the static graphic fields 30–37, slightly below and to the right of the various components of the static fields 30–37, for reasons which will be apparent.

One feature of one aspect of the invention is the printing of the code fields 20*a*–27*a* and 20*b*–27*b* in different directions on the same side of the sheet 10. One or more of the components of the static graphic fields 30–37 printed on the first side 14 of the core 12 typically contains text which is printed left to right across the sheet 10 when sheet 10 is viewed in the orientation it is presented in FIG. 1 with its shorter sides horizontal and located at the top and bottom of the sheet 10. As can be seen in FIG. 1, the bar and numeral format codes in the first code fields 20*a*–27*a* are printed in a first direction, namely the horizontal direction in each of those first code fields. The numeral format codes in each of the second plurality of code fields 20*b*–27*b* are printed in a direction transverse to the horizontal direction of the corresponding first code field 20*a*–27*a* of each set, preferably in a vertical direction, perpendicular to the horizontal direction in which the codes of the first plurality code fields 20*a*–27*a* are printed. While perpendicular directions are preferred for the first direction and the transverse direction in which the code sets are printed, the first and transverse directions need not be perpendicular. Nor do the first code fields all have to be printed in the same first direction, even though such an orientation is usually employed, nor do the second code fields have to be printed in the same transverse direction. As was indicated above, the first code field 20*a*–27*a* of each set of code fields is located in the same orientation and position, namely, partially below and partially to the right of a proximal one of the first plurality of static graphic fields 30–37, respectively. This conveniently permits the static graphic fields 30–37 and first code fields 20*a*–27*a* to be grouped together to produce an identical plurality of removable elements, as will be shortly described.

Referring to FIG. 2, the second side 16 of the core 12 preferably may be printed with a second plurality of static graphic fields, each field being indicated collectively at 40–47, respectively. Each of the second static graphic fields 40–47 in the depicted embodiment includes, for example, four separate components indicated by rectangular dot dashed lines and shading. These are numbered individually for the first field 40 as 40*a*, 40*b*, 40*c* and 40*d* for clarity. Again, the details of the second plurality of static graphic fields are immaterial to the invention. Typically, each of the second plurality of static graphic fields 40–47 is identical to one another and is preferably positioned identically opposite with respect to separate ones of the first code fields 20a–27a and the first plurality of static graphic fields 30–37 on the first side 14 of the core 12.

Preferably, after printing, there is applied to the first side 14 of the core 12, a first covering which is indicated generally at 54 in FIG. 3. Its edges can be seen in FIG. 2 and one edge is numbered 56. The first covering 54 suggestedly covers at least a central portion of the first side 14, overlying all of the code fields 20a–27a and first static graphic fields 30–37. In this embodiment, the first covering 54 may extend to the long side edges of the core 12 covering the second printed code fields 20b–27b as well. Preferably, the covering 54 is at least sufficiently transparent to read the underlying printed fields 20a–27a, 20b–27b and 30–37. One of ordinary skill will appreciate that code fields can be "read" in various ways. The first covering must be sufficiently transparent in the visible light spectrum to permit human reading of the code field. However, the first covering may be transparent only in some other spectrum, for example, the infrared spectrum or ultraviolet spectrum. While not transparent to human visual examination, such a covering can be sufficiently transparent to known optical reader devices to permit reading of the machine readable representation of the unique code underlying the covering by such devices. A second covering 56 is preferably applied to the second side 16 of the core 12. Preferably, the second covering overlies only a central portion of the second side 16 containing at least a major portion of the second plurality of static graphic fields 40–47 printed on the second side. Preferably, the second covering is directly opposite at least the first plurality of code fields 20a–27a and at least most if not all of the first plurality of printed static fields 30–37. Again, the second covering 56 is at least sufficiently transparent to read the underlying printed static fields 40–47.

Also, preferably applied to the second side 16 of the core 12 are two stripes 60 and 64 of pressure sensitive adhesive. Preferably, the stripes 60 and 64 are applied directly opposite the second code fields 20b–23b and 24b–27b, respectively. In the embodiment of the invention depicted in FIGS. 1 through 3, strips of release paper 62 and 66 directly overlie the stripes of pressure sensitive adhesive 60 and 64, respectively.

The sheet product 10 is scored through the core 12 and, where present, the first covering 54, second covering 56 and adhesive layer 60, 64. This scoring is indicated by diagrammatically by unnumbered, bold dotted lines in FIGS. 1 and 2. The scoring defines a plurality of sets of elements which are removable from the sheet product 10. In particular, eight sets of removable elements, a number of sets equal to the numbers of sets of code fields, first plurality of static graphic fields and second plurality of static graphic fields printed on the core 12, are provided in product 10 by the scoring. Preferably, a first removable element of each of the eight sets of removable elements is a generally rectangular, transaction element and is indicated at 70a–77a. Each of the elements 70a–77a includes on one side, which is the second side 16 of the core 12 and product 10, a substantially identical portion of one of the second plurality of static graphic fields 40–47 which was printed on that side. Each element 70a–77a also includes on an opposing side, which is the first side 14 of the core 12 any product 10, a separate, substantially identical portion of one of the first plurality of static graphic fields 30–37 and an at least one of the first and second plurality of code fields, preferably, the first plurality of code fields 20a–27a. The elements 70a–77a can be used as a credit card (with or without magnetic stripe as will be discussed), identification card, membership card, etc. If desired, a closed perimeter opening can also be scored through the sheet product within each removable element 70a–77a, to permit the element 70a–77a to be mounted on a key chain or other key holder like a key or to receive a key chain or ring or the like and be used as a key fob supporting one or more keys on such chain or ring or the like.

The second removable element of each set is denoted at 70b–77b and consists of a portion of the product 10 having on one side, which was the first side 14 of the core 12 and product 10, one of the second set of code fields 20b–27b, respectively. Each removable element 70b–77b includes on its remaining side, which was the second side 16 of the core 12 and product 10, a portion of one of the two stripes 60 and 64 of pressure sensitive adhesive. Elements 70b–77b can be used as labels or tabs on an application or membership form, etc., of the person receiving the corresponding card element 70a–77a of the set.

The scoring has been indicated diagrammatically for several reasons. First, the exact type of scoring used, e.g., long, continuous cuts with short breaks, closely spaced perforations, etc. is a matter of choice. Furthermore, the product 10 without the scoring and without the release paper strips 62 and 66, is an intermediate sheet product which can be used to make a somewhat different sheet product indicated generally at 110 in FIGS. 4 through 6.

Figure 4:
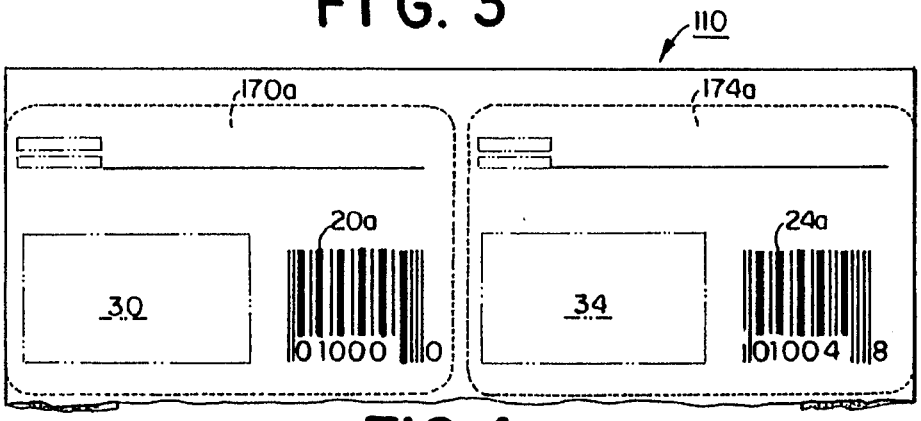
FIG. 4 depicts diagrammatically part of a first side of a second printed sheet product.
Figure 5:
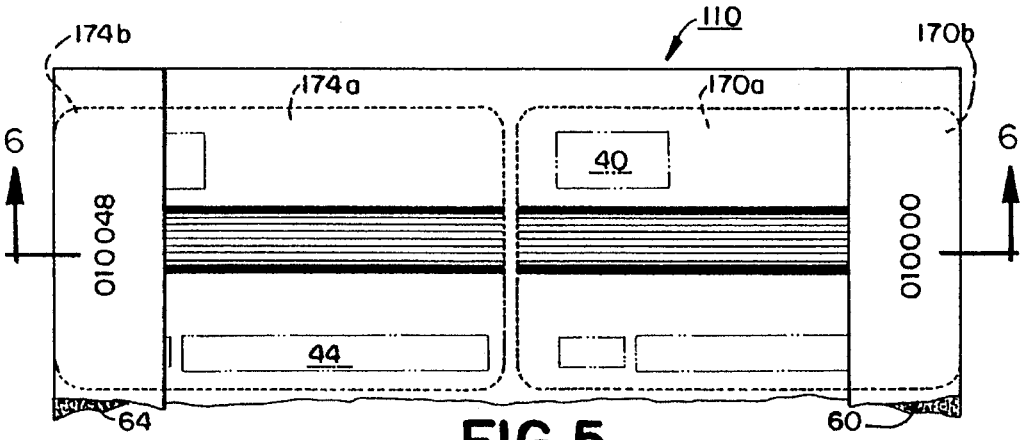
FIG. 5 depicts diagrammatically part of a second, opposing side of the sheet product of FIG. 4.
Figure 6:
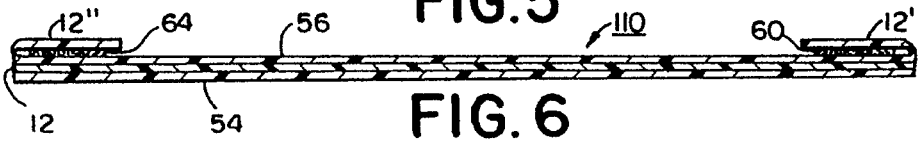
FIG. 6 depicts diagrammatically a cross section through the second sheet product of FIGS. 4 and 5 along the lines 6—6.

Product 110 in FIGS. 4 through 6 is so similar to the sheet product 10 of FIGS. 1 through 3 that only a top portion of product 110 is shown in FIGS. 4 and 5 to highlight the differences between the two embodiments 10 and 110. The sheet product 110 is formed from an intermediate sheet product also used to form the sheet product 10 of FIGS. 1 through 3. That intermediate product includes the core 10, the pluralities of code fields 20a–27a and 20b–27b and the first plurality of static graphic fields 30–37 printed on the first side 14 of the core 12 (FIG. 4) and the second plurality of static graphic fields 40–47, respectively, printed on the second side 16 of the core 12. Stripes 60 and 64 of pressure sensitive adhesive are also provided along the second side 16 of the core 12 adjoining the longer side edges of the core 12 and directly opposite the second code fields 20b–23b and 24b–27b, respectively, only fields 20b and 24b being indicated in FIG. 4. This intermediate sheet product is therefore identical to the sheet product 10 of FIGS. 1–3 except that it lacks the strips of release paper 62 and 66 and the scoring. The side edge portions of the first covering 54, overlying the second code fields 20b–27b can also be eliminated as a cost savings. This intermediate product is indicated in FIG. 7 at 100.

Figure 7:
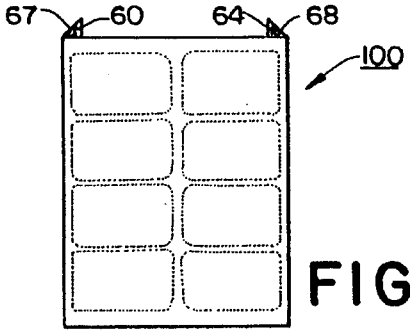
FIG. 7 depicts diagrammatically an intermediate step in making the sheet product of FIGS. 4–6.
Figure 8:
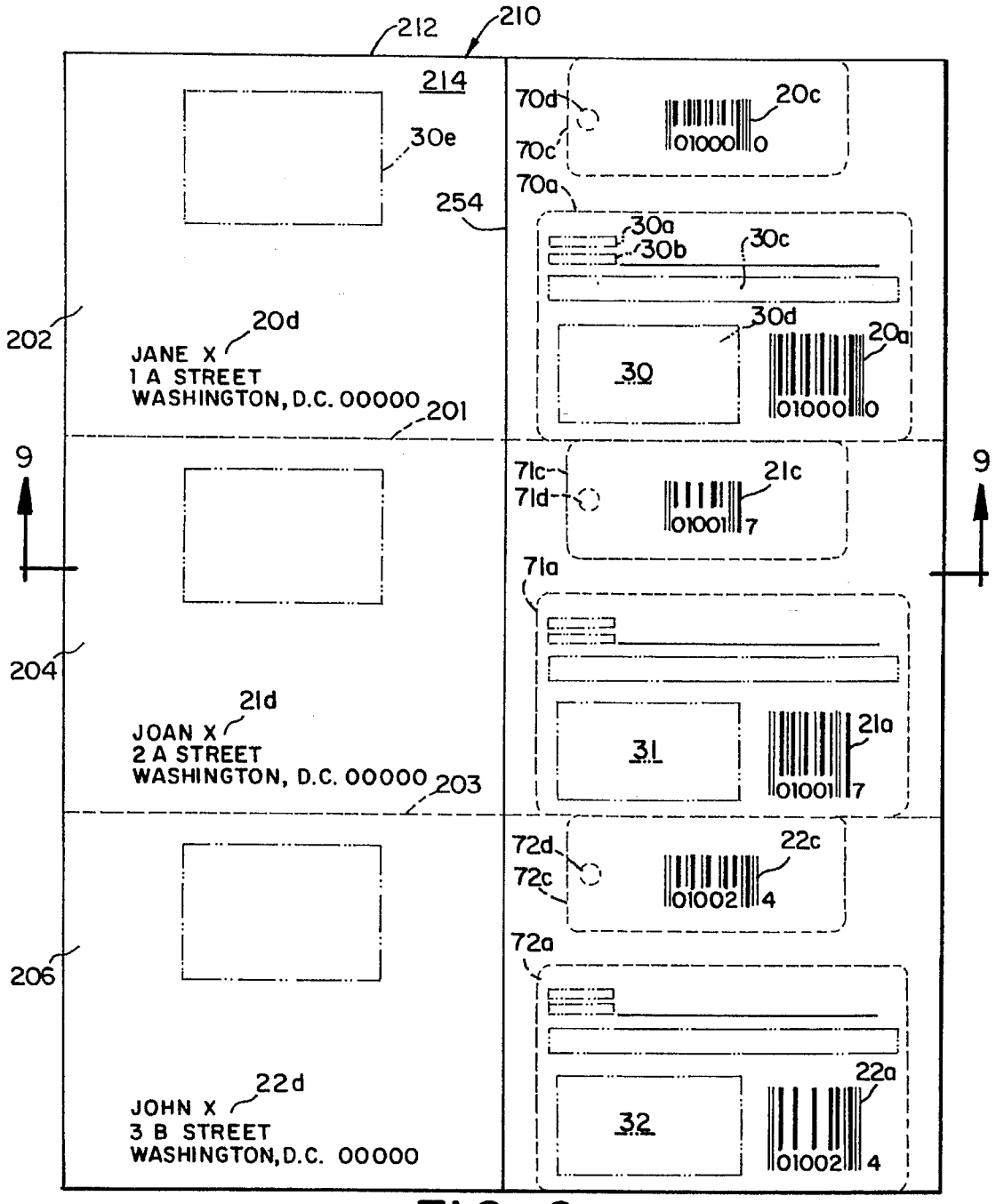
FIG. 8 depicts diagrammatically a first major planar side of a third printed sheet product.
Figure 9:
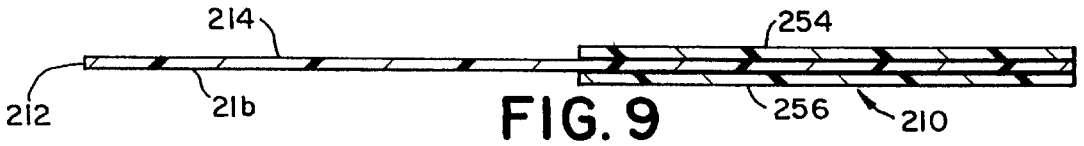
FIG. 9 depicts diagrammatically a cross section through the sheet product of FIG. 8 along the lines 9—9.

In converting this intermediate product 100 into the sheet product 110 of FIGS. 4–6, the first and second longitudinal edge portions 67 and 68 of the core 12, bearing the adhesive stripes 60 and 64, respectively, of the sheet product 100 are turned, as is indicated diagrammatically in FIG. 7, onto an adjoining portion of the core 12 and sheet product 100 forming a double thickness of the core 12 along the longitudinal edges of the resulting sheet product 110 part of which is indicated in FIG. 6. The sheet product 110 formed in this manner is thereafter scored, the scoring again being indicated by the unnumbered, bold dotted lines in FIGS. 4 and 5. The scoring defines plural sets of plural elements removable from the sheet product 110 and removably adhered to one another by the intervening adhesive stripe 60 or 64. In the depicted embodiment 110 continuous cuts have been made along the longer, folded side edges of the intermediate product 100 to define the outer side portions of the removable elements FIGS. 8 and 9 depict a third printed sheet product of the present invention indicated generally at 210. The sheet product 210 again includes a thin, flexible core 212 like core 12 of products 10 and 100/110 (see FIG. 3) which, again, is the size of the product 210 depicted in FIG. 8 and which has a pair of major planar opposing sides 214 and 216 seen in FIG. 9, a first major planar side 214 of which is depicted in FIG. 8. There is printed on the first major planar side 214 of the core 212 a plurality of sets of variable data fields. In the depicted product 210 three variable data field sets of three variable data fields each are printed but as few as two and more than three separate variable data fields could be printed for each set. Again, a first variable data field of each of the three variable data field sets is a code field identified generally at 20*a*, 21*a* and 22*a*, respectively. Another data field of each of the three data field sets is a second code field indicated at 20*c*, 21*c* and 22*c*. Each of these data fields 20*a* through 22*a* and 20*c* through 22*c* is printed with a unique code, preferably in both bar code and numeric formats. As with the previous sheet products, the unique code of each variable data field set is unique to the set and different from the unique code of each other set of variable data fields printed on the first side 214 of the core 212.

In addition, each set of variable data fields includes another data field indicated at 20*d*, 21*d* and 22*d*, respectively, printed with a name and mailing address uniquely associated with the unique code of the set of printed variable data fields. The name and address of each of the data fields 20*d*, 21*d* and 22*d* is unique to the set 20, 21 or 22 and is different from the name and address of each of the other data fields 20*d*, 21*d* and 22*d* also printed on the first side of the core.

As is depicted in the figure, each of the various individual variable data fields 20*a*, 20*b*, 20*c*, 21*a*, 21*b*, 21*c*, 22*a*, 22*b* and 22*c* is spaced from one another for purposes which, if not already apparent from the previous discussion, will become apparent from the following discussion.

The first side 214 of the core 212 may also be printed with a first plurality of static graphic fields, represented by the various dashed and double-dotted blocks indicated collectively at 30 through 32, respectively. Such static graphic fields typically contain text and/or graphic designs which are repeated. In the embodiment being depicted, each static graphic field has five separate components numbered individually for the first of the static graphic fields as 30*a* through 30*e*, respectively. In this embodiment, each of the unique codes in the code-type variable data fields 20*a* through 22*a* and 20*c* through 22*c* is printed in the same orientation but could be printed in directions transverse to one another, if desired. As was the case with the previously discussed embodiments, the second major planar side 216 of the core 212 of the sheet product 210 can be printed with static graphic fields backing any of the fields printed on the first side of the core depicted in FIG. 8.

Preferably, a first covering is applied over a portion of the first side 214 after printing the static graphic fields and the variable data fields on the first side 214 of the core 212 of the depicted sheet product 210. The first covering of sheet product 210 is indicated generally at 254, the lead line of which extends to an edge of the first covering in FIG. 8. In this particular sheet product 210, the first covering 254 preferably covers only the right half of the sheet product overlying each of the variable data code fields 20*a* through 22*a* and 20*c* through 22*c*. The first covering 254 avoids the printed variable data address field 20*d* through 22*d*. Again, the first covering 254 is preferably at least sufficiently transparent to humans and/or machines to read the underlying printed variable data code field 20*a* through 22*a* and 20*c* through 22*c*. As was the case with sheet product 10 of FIGS. 1 through 3, a second covering 256 is preferably applied to the second major planar side 216 of the core 212 of the sheet product 210 directly opposite the first covering 254 and the variable data code fields 20*a* through 22*a* and 20*b* through 22*b*. The second covering 256 again can be transparent, if desired, to permit the reading of any variable data or static graphic fields which may be printed on the second major planar side of the core of the sheet product 210.

The sheet product 210 is preferably scored through its core and, where present, its first covering 254, second covering 256 and any other covering, such as an adhesive layer (not depicted). The scoring is indicated diagrammatically by bold, dotted lines in FIG. 8. Sheet product 210 differs from the previously described sheet product in that the scoring preferably includes two horizontal score lines, which are indicated at 201 and 203, respectively, which define the sheet product 210 into three sheet sections indicated at 202, 204 and 206, respectively. Each of the sheet sections 202, 204 and 206 contains a separate one of the plurality of sets of printed variable data fields (20, 21 and 22, respectively). Thus, sheet section 202 includes the three variable data fields 20*a*, 20*c* and 20*d* constituting the first variable set of data fields of sheet product 210. Sheet section 204 contains the second set of variable data fields 21*a*, 21*c* and 22*d* while the third sheet section 206 contains the third set of variable data fields 22*a*,22*c* and 22*d*.In addition, scoring preferably defines at least one and preferably sets of two or more elements which are removable from each sheet section 202, 204 and 206. In particular, three sets of removable elements, equal to the number of sets of printed variable data fields, are provided in the sheet product 210 by the scoring. Preferably, the first removable element of each of the three sets of removable elements is a generally rectangular, card-sized transaction element and is indicated at 70*a*, 71*a* and 72*a*,respectively. Again, each of the elements 70*a*, 72*a* can include on a second side of the core of the product 210 a substantially identical portion of identical static graphic fields which may be printed on that side of the core and product. Again, each element 70*a*–72*a* also includes substantially identical portions of the first plurality of static graphic fields 30, 31 and 32 which are printed on the first side 214 of the core 212 forming the first side of sheet product 210. Each of the indicated first removable elements 70*a*, 71*a* and 72*a* is generally rectangular and about two inches by about three inches in size, approximating the size of a business card or credit card and may be used as a credit card, identification card, membership card, etc.

The second removable element of each sheet section 202, 204 and 206 defined by the scoring is identified at 70*c*, 71*c* and 72*c*, respectively. Like the first removable element, each second removable element 70*c*, 71*c* and 72*c* may include identical portions of static graphic or variable data fields printed on a second side of the core of sheet product 210 (not depicted). Removable elements 70*c*, 71*c* and 72*c* are preferably generally rectangular and smaller than removable elements 70*a*, 71*a* and 72*a*, respectively, preferably less than two inches along one side, such as either vertical side in FIG. 8, and less than three inches along another side, namely either horizontal side adjoining either vertical side in FIG. 8, to define a slightly smaller, removable element. Preferably the scoring defines a closed perimeter 70*d*, 71*d* and 72*d* opening through the sheet product 210 within each of the removable elements 70*c*, 71*c* and 72*c*, respectively. The closed perimeter openings 70*d*, 71*d* and 72*d*, extend transversely through the plane of the sheet product 210 and of each of the elements 70*c*, 71*c* and 72*c* and permit the element 70*c*, 71*c* and/or 72*c* to be used as a key tag lying flat and parallel planar with keys on a key chain or ring or in a key case. Alternatively, each element 70*d*, 71*d* and 72*d*, coated with suitably strong coverings 254 and 256 could be sufficiently strong, rigid and durable enough to act as a key fob supporting a key chain, key ring or like key fastener. Preferably, each of the removable elements 70*c*, 71*c* and 72*c* is approximately two and one-half by one inches in size for more convenient interleaving with conventionally sized keys.

Figure 10:
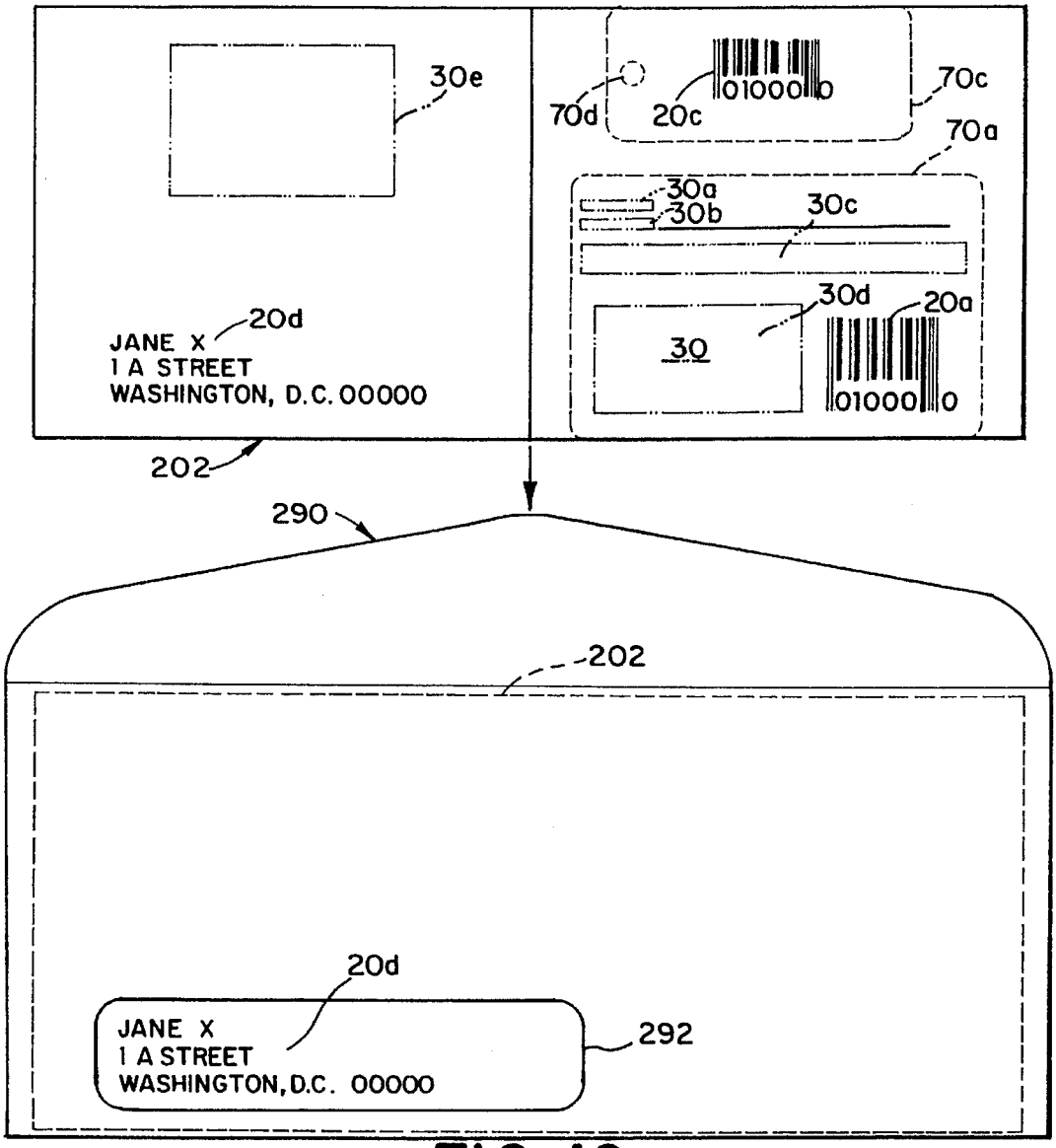
FIG. 10 depicts diagrammatically the insertion of a sheet section of the sheet product of FIG. 8 inserted into a standard size business envelope.

Each of sheet sections 202, 204 and 206 is also preferably sized to fit into a standard-size envelope without folding. For example, each of the sheet sections can be formed by one-third of an eight and one-half by eleven inch single sheet product to be easily inserted into standard No. 9 or No. 10 size envelopes. Other standard envelope sizes may be used. For example, each section 202, 204 and 206 need only be less than four and one-half inches in height and ten and five-sixteenths inches in width to be capable of being inserted without folding in a standard No. 11 size business envelope. FIG. 10 depicts diagrammatically the insertion of sheet section 202 into a standard business size (No. 10) envelope indicated at 290. Preferably, the variable data address field 20*d* is positioned on the sheet section 202 to align with a window 292 through the front wall of the envelope. In this way, each sheet section 202, 204 and 206 is self-addressed.

While FIG. 8 depicts the division of a sheet product 210 into three individual sheet sections, each sized to essentially fully fit a standard size business envelope (e.g. No. 9 or No. 10) without folding of the section or significant movement of the section within the envelope, one of ordinary skill will appreciate that other sheet product and sheet section sizes can be conveniently employed. For example, a standard eight and one-half by eleven inch sheet product according to the present invention can be provided and scored to define into six sheet sections of equal size, namely about three inches in height by about four inches in width. One such sheet section 302 is indicated diagrammatically in FIG. 11. A first variable data code field 20*a* includes bar and numeral or other machine readable representations of a unique code and forms part of a removable element 70*c* of the sheet section. A second, variable data address field 20*d* is printed below. Removable element 70*c* may be provided with a closed perimeter opening indicated in phantom at 70*d* permitting use of the element 70*c* as a key tag or fob. The sheet section 302 can be inserted without folding into a comparably sized envelope or tipped onto a carrier 301 about four inches high and eight to nine inches wide, which can itself be received in a standard No. 9 or 10 size envelope without folding.

Advantages of the invention in the form of the sheet product 210 and like sheet products including sheet sections with a variable data address field is that both the address field and the unique code field(s) can be printed at the same time in a single pass of the core of the sheet product through a single printer. This insures accuracy and integrity between the variable data address field and unique code field(s) of each sheet section.

The core 12 of each sheet products 10, 100/110 and 210 can be any thin sheet or web material having two major planar opposing sides, which can be printed upon. Preferably, the core is a flexible material which can be used with conventional, high speed, offset printing machines. Acceptable materials include metal foils, cellulose based products, fabrics, cloths and preferably plastics including, for example, ABS, acetates, butyrates, phenolics, polycarbonates, polyesters, polyethylenes, polypropylenes, polystyrenes, polyurethanes and polyvinyl chlorides as monomers, copolymers and/or laminates. For example, the following specific trademarked products may be useful: Polyart I and II of Arjobex Synthetic Papers; various grades of GP700 from Bexford Limited (Engl.); Kapton, Tedlar and Telar of DuPont; Fascal, Fasprint and Crack n' Peel Plus of Fasson; Lasercal, Compucal II and Datacal Coating of Flexcon; Kimdura of Kimberly Clark; various grades of Pentaprint PR of Klockner Pentaplast; various grades of LLM-LV and Data Graphic II LLM of Lamart; Teslin of PPG Industries; the following products of Stanpat: APL-100, -110, -120, -150, -200, UM-546, UC-546, PPC-410, -450 and -460; and the following products of Transilwrap: Proprint, Transilprint, Transilmatte, T.X.P., Eve, Trans-Alley, Transglaze, Trans-AR, Trans V.L. and T Print; and others. These brand name products are treated or constructed in some fashion to make them particularly suited for use in one or more types of printing processes. Details regarding these products and companies and others are available to those of ordinary skill in the art through various sources including but not limited to published references such as AUTOMATED ID NEWS 1993–1994 REFERENCE GUIDE AND DIRECTORY, published and distributed by Advanstar Communications, Cleveland, Ohio.

Each of the first and second coverings 54 and 56 can be any material which is suitably and sufficiently transparent and which can be applied to the core material selected in any suitable fashion for the material(s) selected without adversely affecting the core or the printing thereon. The coverings might be, for example, sheets or webs of any of a variety of transparent Transcote FG and Copolymer plastic films of Transilwrap, Inc. of Chicago, Ill., which are transparent in at least the visible and infrared light spectrums or any of a variety of similarly transparent Durafilm plastic films of Graphic Laminating, Inc. of Cleveland, Ohio. The plastic films are preferably adhered to the core with an adhesive appropriate for use with the materials selected for the core and transparent covering. Typically, polymer based adhesives are used with the exemplary plastic films identified above.

In addition, such laminate films can be obtained from various commercial sources incorporating one or more magnetic (magnetizable) stripes, of the type found on most common credit cards. Alternatively, a separate magnetic stripe can be applied to the transparent covering in a conventional manner for such materials, such as by hot stamping. In such case(s), the removable elements 70*a*–77*a* (FIGS. 1 and 2), 170*a*–177*a* (FIGS. 4 and 5) and 70*a*–72*a* (FIG. 8) may be vertically oriented on each sheet 10, 100/110 and 210 (90' from the indicated orientation in the figures) to run the magnetic stripe(s) continuously along columns of such elements.

For the particular removable elements being made in the preferred embodiments disclosed in this application, namely, transaction size elements such as cards, key tags and fobs and labels, the above-identified coverings are preferred, as they provide a layer of polyester having good strength, wear and soil resistant properties which can be used on the outer side of the products 10, 100, 110. The pressure sensitive adhesive used may be any conventional, commercially available, pressure sensitive contact adhesive suitable for use with the particular materials selected for the sheet product. For the embodiments being described, double coated, permanent adhesive transfer tapes, such as those available from Enterprise Tape Company of Dalton, Ill., for example, are suitable.

The preferred methods of manufacturing the preferred sheet products 10, 100 and 110 are quite similar and straightforward. Preferably, the static graphic fields are printed first on each selected side of the core material selected. Any known, conventional type of printer and printing process may be used including, for example, flexographic, offset lithographic, silkscreen, letter press, thermal transfer, thermal direct, ink jet, color laser, formed character impact, hot stamp, electrostatic, ion deposition, magnetographic, dot matrix, cycolor, photographic silver halide, sublimation, diffusion, pad, gravure, spray painting, dyeing, electrolytic plating, electroless plating, sputter deposition, in-mold decorating, flocking, embossing, vacuum evaporation metallizing, engraving, hot transfer, electrophotographic printing or electro ink printing process. Preferably, a high speed printing process such as flexographic or offset lithography is used to print on continuous webs of thin flexible planar material for efficiency and cost. A printing method and machine capable of simultaneously printing the first and second sets of static graphic fields on the first and second sides of the web in one pass through the printer is preferred for efficiency, but single side printing in separate passes may be preferred for quality.

Next, the core bearing the printed static graphic fields preferably is passed through a variable data field printer, preferably a programmable printer capable of printing variable data fields in at least bar and character format on at least one side of the core, which becomes the first side of the sheet products, in a single pass of the core through that printer. "Character" encompasses at least alphanumerics and conventional punctuation symbols. Commercially available printers having this capability include thermal transfer, thermal direct, ink jet, color laser, formed character impact, electrostatic, ion deposition, magnetographic, dot matrix, photographic and sublimation and are available from almost an innumerable list of suppliers. Again, printers printing on continuous webs are preferred for efficiency but printers printing on individual sheets (cut lengths of web) are preferred for quality. Currently, thermal transfer and laser printers are preferred in the industry for variable format printing, particularly of characters and bar codes. Generally speaking, existing thermal transfer printers provide high quality, sharp characters and bars while laser printers provide characters and bars which are not as sharp but more consistent in thickness. Improvements continue to be made to both ink jet and ion deposition printers as well. Ink jet and/or ion deposition printers may be preferred for speed. However, at least currently available machines, generally speaking, do not provide the quality provided by currently available thermal transfer and laser printers. Currently, laser printing is preferred for the particular embodiments 10, 100 and 110 being described. For example, laser printers are made and/or distributed in the United States by such well-known corporations as Hewlett-Packard, IBM, Kodak, NCR, Panasonic, Pentax, Ricoh, Siemans, Toshiba and Xerox. In addition, literally dozens of other, smaller manufacturers offer programmed or programmable printers which can be used or can be configured to be used to perform the steps indicated above. Again, the material selected for the core 12 should be compatible with the preferred printing method and equipment or the printing methods and equipment selected to be compatible with a preferred material. For example, for laser printing, a microvoided polysilicate plastic sheet material, having at least about sixty percent porosity is preferred.

The programmable code field printer selected preferably is configured to print each of the variable data fields. With respect to sheet products 10, 100/100 the first plurality of code fields 20*a*–27*a* are printed in a first direction and the second plurality of code fields 20*b*–27*b* in a direction transverse to the first direction of the first code field of the set on the one side of the sheet or web constituting the first side 14 of the core 12. As is indicated in FIGS. 1, 2 and 4, 5, the bars and numerals of the first plurality of code fields 20*a*–27*a* are printed in a portrait mode running horizontally across the sheet 10, while the second plurality of code fields 20*b*–27*b* are printed in a landscape mode running vertically along the side edges of the sheet 10. This is accomplished in straightforward fashion by simply programming the computer to identify the characters to be printed at predetermined locations on the web in defined angular orientations to the web. In this way, all of the code fields are printed on the web in a single pass of the web through the printer. Preferably, the first and second coverings 54 and 56 are then applied to the opposing sides 14 and 16 of the web in a conventional manner for the covering material selected. The stripes of pressure sensitive adhesive 60 and 64 are also applied, with or without release paper 62 and 66, respectively, for the embodiment 10, 100 or 110 selected.

Separate printing of static graphic and variable data fields is presently preferred for speed, cost and quality. However, the capabilities of programmable printers continues to improve in all three categories. In some instances, it is already possible to simultaneously print certain types of static graphic and variable data fields at the same time using the same programmable printer in a single pass of the core through the printer. Duplex printers are now becoming available which permit the printing of variable data fields on both sides of a core in a single pass through such printers. Sheet products printed by such devices are intended to be encompassed by the present invention. The present invention is also intended to cover all instances where static graphic fields may be printed before, after or simultaneously with the variable data fields on one or both sides of a continuous or cut length core.

Next, if the first embodiment sheet product 10 is produced, the printed, covered web is preferably fed through a cutter which scores the sheet products 10 through the core 12, covering 54 and 56 and stripes 60 and 64, where present, to define the sets of removable elements 70*a*–77*a* and 70*b*–77*b* and cuts a continuous web into the individual sheet product lengths if a continuous web is used. If the second embodiment sheet product 110 is being made, the side edge portions 67, 68 bearing the pressure sensitive adhesive strips 60 and 64 may be folded by conventional stock folding equipment upon an immediately adjoining central portion of the web. The longitudinal edge folded web product is thereafter preferably fed through a cutter which scores each of the individual sheet products 110 to define the plurality of sets of removable elements 170*a*–177*a* and 170*b*–177*b* and cuts the continuous web into the individual sheet product lengths 110 if a continuous web is used.

Sheet product 210 and similar sheet products are made in a similar fashion. In particular, the plurality of sets of variable data fields 20*a*–22*a*, 20*c*–22*c* and 20*d*–22*d* are printed on the first side 214 of a pair of opposing major planar sides 214, 216 of the thin core 212. Each set of printed variable data fields, collectively 20, 21 and 22, includes at least a first data field 20*a* or 20*c*, 21*a* or 21*c* and 22*a* or 22*c*, printed with a unique code preferably in at least a bar or other machine readable format. The unique code of each set of variable data fields 20, 21, 22, printed on the first side 214 of core 212 is different from the unique code of each other set of the variable data fields 20, 21, 22 printed on the first side 214 of core 212 and each set of variable data fields further includes a second data field 20*d*, 21*d*, 22*d* printed with a name and mailing address uniquely associated with the unique code of the set of printed data fields 20, 21 and 22. The name and address of the second data field 20*d*, 21*d*, 22*d* of each of the sets of printed variable data fields 20, 21 and 22 are different from the name and address of the second data field of each other set of the data fields 20, 21, 22 printed on the first side 214 of the core 212. All of the variable data fields 20, 21 and 22 preferably are printed in one pass of the first side 214 of the core 212 through a suitable printer. A first cover 254 is applied to the first side 214 of core 212 overlying at least one and preferably both variable data fields 20*a*–22*a* and 20*c*–22*c*, while preferably avoiding each of the name and address variable data fields 20*d*, 21*d* and 22*d*, to save manufacturing costs. Again, the preferred plastic film coverings identified are adhered or otherwise laminated in suitable, known ways for the materials involved to the first side 214 of the core 212 and are sufficiently transparent in the visible light and infrared spectrum to permit observers and suitable optical equipment, such as conventional infrared laser-equipped bar code readers, to read and decipher the bar format code underlying the first covering 254. Again, a second, similar, if not identical, covering 256 is applied to the second major planar side 216 of the core 212, opposite the first covering 254. The sheets 210 are thereafter scored completely, or nearly completely, through the core 212 and coverings 254, 256 to divide the sheet product 210 into the plurality of sheet sections 202, 204 and 206 and to define at least one, and in the case of sheet product 210, two elements 70*a* and 70*d*, 71*a* and 71*d* and 72*a* and 72*d*, in each sheet section 202, 204 and 206, respectively, removable from the sheet section. Simultaneously, closed perimeter openings 70*d*, 71*d* and 72*d* are similarly scored through the sheet product 210 within one of the two removable elements of each of the sheet sections 202, 204 and 206 to permit those elements 70*c*, 71*c*, 72*c* to be used as key tags or fobs. Each sheet section 202, 204 and 206 of the sheet product 210 can thereafter be inserted into a separate envelope 290 with the address field 20*d*–22*d*, respectively, aligned with the window 292 through the envelope 290.

It will be recognized by those skilled in the art that changes could be made to the above-described embodiments. For example, in addition to printing unique code fields for each associated set of elements, other fields can be reserved for printing other data uniquely associated with the code or with the person or entities ultimately assigned the codes, for example, names, addresses, phone numbers, dates, vital statistics, etc. Many if not most programmable printers are capable of reading such data from a conventional data storage device, such as a tape drive, disk drive, etc. and printing the information in fields which are predefined with respect to the core 12 and, preferably, with respect to one or more of the removable elements which are ultimately defined on the core.

Also, although one transaction sized laminated card and one adhesive back tab or label have been identified in the disclosed embodiments as constituting each set of removable elements, additional and/or alternate elements can be provided. For example, multiple transaction sized cards, multiple labels, and other elements including, for example, an element having a hole or opening cut therethrough for attachment to a key ring, hook or the like, can be provided.

One of ordinary skill will appreciate the order in which steps are taken may be immaterial. For example, while printing a static graphic field initially on a continuous web is preferred for rapid, inexpensive printing, static fields can be printed directly on cut sheets. Typically, it will also be immaterial whether the code fields are printed before, after or during the printing of the static graphic fields. Further, the order in which coverings are applied is generally not critical, and coverings could be applied to one side of a core after printing upon that side is completed and before printing is performed on the other side of the core.

Next, one of ordinary skill should be aware that it is now also possible to first laminate a tough, protective transparent film of vinyl or polyester to a relatively inexpensive core of PVC or other inexpensive backing or stock material and print variable data (and/or static graphic) fields directly onto the vinyl or polyester laminate layer. Smudge resistant, scratch resistant, high resin thermal transfer films now available from such manufacturers as Sony and Ricoh are sufficiently adhesive and tough that they do not require a protective film covering. The invention is intended to cover such sheet products as well. In such instances, the core will actually be a laminate.

Figure 11:
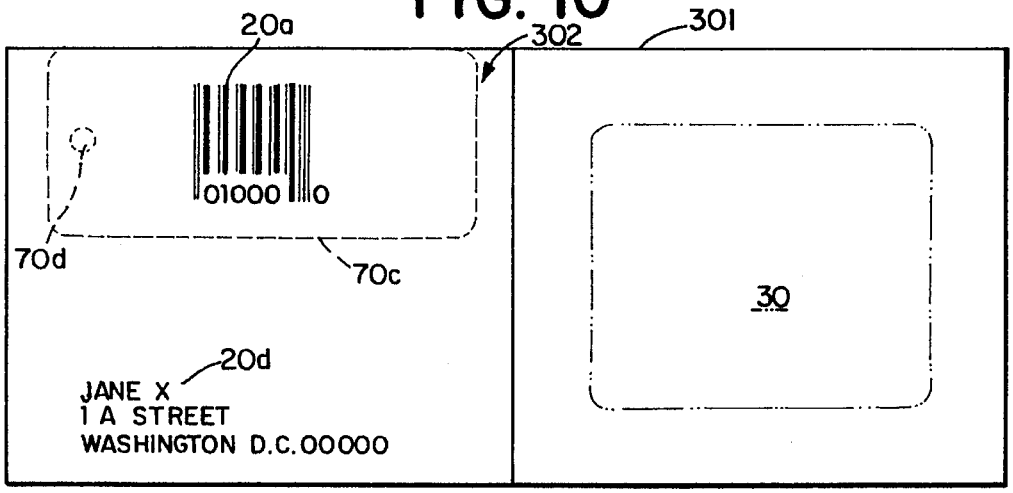
FIG. 11 depicts diagrammatically an alternate embodiment of a fourth embodiment sheet product.
Figure 12:
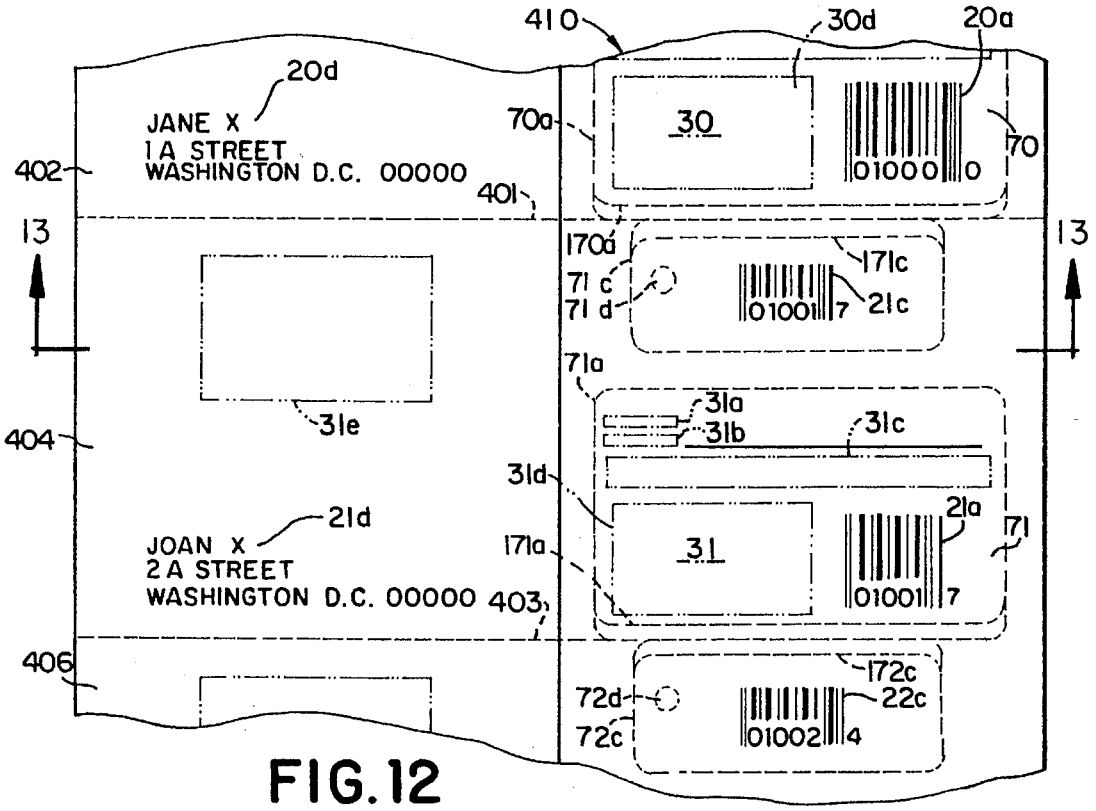
FIG. 12 depicts diagrammatically a fifth embodiment sheet product.
Figure 13:
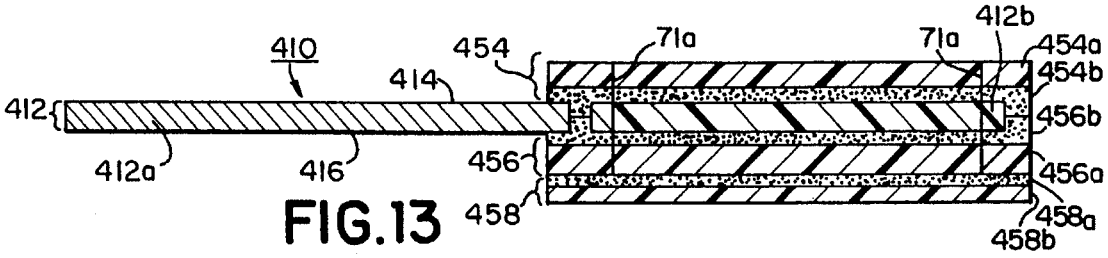
FIG. 13 depicts diagrammatically a cross-section of the embodiment of FIGS. 12 taken along the line 13—13 in FIG. 12.

FIGS. 12 and 13 depict a fifth printed sheet product of the present invention indicated generally at 410. The sheet product 410 includes a thin, flexible core 412 similar but not identical to cores 12 and 212, but which still has a pair of major planar opposing sides 414 and 416 seen in FIG. 12. The first major planar side 414 is depicted in FIG. 11. There is preferably printed on the first major planar side 414 of the core 412 a plurality of sets of variable data fields. In the depicted sheet product 410, one full set of and two partial adjoining sets of data fields are shown. Again, each data field set includes at least two or more separate variable data fields, three data fields 21*a*, 21*c* and 21*d* of the full data set being depicted while adjoining data fields 20*a*, 20*d* of one set and 22*c* of another set are shown. Again, the individual variable data fields are spaced from one another in each set and between sets. Either or both sides 414, 416 of core 412 may also be printed with a first plurality of static graphic fields, again indicated collectively and by example only at 30*d* and 31*a*–31*e*. Again, the second major planar side 416 can be printed as indicated earlier for any of the previous embodiments.

Referring now to FIG. 13, it will be seen that the core 412 differs from the previous cores 12 and 212 in that it is formed of two separate sheets of material 412*a* and 412*b* which generally adjoin one another longitudinal edge to longitudinal edge side-by-side. The sheets 412*a*, 412*b* are preferably held together by at least a first covering 454, which preferably overlaps at least portions of each of the sheets 412*a*, 412*b* and further overlaps at least over the unique, at least machine readable code variable data fields 21*c*, 22*c* on the one sheet 412*b* and yet does not extend over the name and address variable data field 21*d* on the remaining sheet 412*a*. First covering 454 is preferably at least sufficiently transparent to machines and preferably humans to read the underlying printed variable data code fields. Again, as was the case with the previous embodiments, a second covering 456 is preferably applied to the second major planar side 416 of the core 412 directly opposite the first covering 454 and a numeric variable data field code on the first side of the core 412. Preferably, each covering 454 and 456 includes a solid film layer 454*a*, 456*a* which is adhered to the core 412 by an adhesive layer 454*b*, 456*b*. Preferably, adhesive layers 454*b*, 456*b* can be activated in some way, for example by heat, ultraviolet or visible light, to permanently bond the separate sheets 412*a*, 412*b* and coverings 454, 456 together so as to provide a protective outer covering on either side of removable portions of the sheet product 410.

The sheet product 410 is again preferably scored through its core 412 and, where present, first covering 454, second covering 456 and any adhesive layers adhering those coverings to the core. Horizontal score lines 401 and 403 in FIG. 12 define opposing upper and lower edges of one of the plurality of sheet sections 404, which sections are scored or otherwise separated from the longer sheet product 410. Each sheet section 404 taken from the sheet product 410 contains a separate one of the plurality of sets of printed data fields. In addition, the scoring preferably defines at least one element which is removable from the sheet section 404. In particular, first element 71*a* is removable from the sheet section 404 and is defined physically be scoring which is represented in FIG. 12 by the bold broken lines indicated by the lead line of reference numeral 71*a*. Scoring is indicated in FIG. 13 by solid vertical lines 71*a*, which define cut sides of the removable element 71*a*. A second removable element 71*c* is defined in FIG. 12 by scoring and is also indicated by the lead line from that reference numeral. Again, a closed perimeter opening 71*d* may be scored within the one removable element 71*c*, as was the case with the third embodiment 210. It will be appreciated that although broken lines 401, 403, 71*a*, 71*c* and 71*d* are used to represent scoring, the score lines 401, 403 and preferably the score lines defining elements 71*a*, 71*c* and 71*d* are continuous cuts. It will be appreciated that score lines 70*a*, 71*a* and/or 71*c*, 72*c* could be continued entirely within the perimeter of each sheet section 402, 404, 406, etc. by providing additional scoring lines, for example, 170*a*, 171*a* (and/or 171*c*, 172*c*) so that a generally rectangular shaped scoring 70*a*/170*a*, 71*a*/171*a*, etc. is provided in each sheet section 402, 404, 406, etc., cutting sufficiently through such sheet section to define at least one removable card element 70, 71, etc. in each sheet section.

If desired, another covering 458 can be applied to one side of one of the existing coverings 454, 456, as indicated in FIG. 13 in phantom. Preferably the covering 458 is preferably releasably bonded to one of the coverings 456, preferably with a pressure sensitive adhesive 458*a*, which will adhere to but release from the opposing covering 456 without delaminating that covering 456 from the core 412 or from the other covering 454. The preferred purpose of providing such an additional covering 458 is to permit the remainder of the sheet section 404 to be scored entirely through the core 412 and immediately facing layers 454 and 456. Conventional scoring equipment can be dimensioned sufficiently accuracy to permit full scoring through the core 412 and coverings 454, 456 while leaving the remaining covering 458 substantially if not essentially unscored. Less desirably, covering 458 can be deleted and small continuous strips of material left between elements 71*a* and/or 71*c* and the remainder of section 404 to retain elements 71*a*, 71*c* in place in the section 404.

Figure 14:
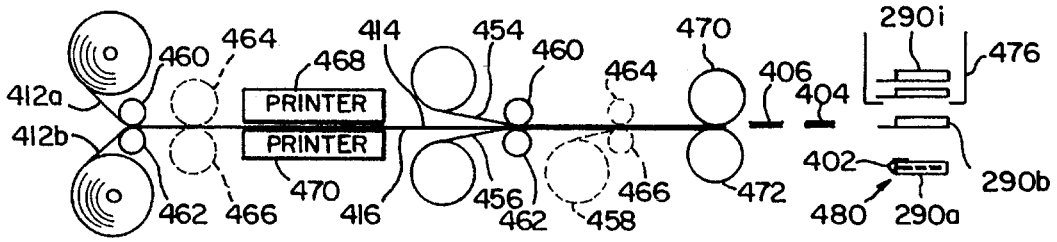
FIG. 14 depicts diagrammatically a line for fabricating the components of an assembling a transaction card mailer.

FIG. 14 depicts diagrammatically the components of a line for making the component of an assembling a transaction card mailer. For the embodiment sheet product 410, the FIGS. 12 and 13, two separate continuous webs of core material 412*a*, 412*b* are fed from separate supply rolls through a pair of aligning nips 460, 462 which hold the two sheets 412*a*, 412*b* in adjoining side by side position until the sheets can be bonded together downstream in the laminating process. The sheets 412*a*, 412*b* may be preprinted with static data fields or printed while being passed through the line, for example, by a continuous web printer indicated diagrammatically and in phantom by opposing print rolls 464, 466. The statically printed sheets are then preferably passed through a variable data field printer 468 which prints all variable data fields on a first side 414 in a single pass of the sheets 412*a*, 412*b* through the printer 468. If desired, a second printer, indicated diagrammatically and in phantom at 470, can be provided opposing the first printer 468 to print on the remaining side 416 of the resulting sheet product 410. After printing, first and second coverings 454 and 456 are preferably applied to opposing sides of the core 412 at least partially overlapping both of the sheets 412*a* and 412*b*. Opposing rolls 460, 462 or other suitable means are preferably configured to activate the adhesive layer supplied with each covering 454, 456, for example by heating or by generating a visible or ultraviolet light while pressing the coverings 454, 456 to the core 412 and preferably to permanently bond and laminate the coverings 454, 456 to the core 412. If provided, the third covering 458 is preferably applied downstream from the rolls 460, 462 so as to not interfere with the activation of the adhesive on the coverings 454, 456. The continuous sheet product 410 is scored, for example by a pair of opposing roll cutters 470, 472, to define the plurality of individual, scored sheet sections 402, 404, 406, etc. which may thereafter be inserted individually into standard, rectangular, business size envelopes 290*a*, 290*i* through a conventional insertion machine, which is indicated diagrammatically at 476. One completed mailer 480 comprising envelope 290*a* and sheet section 402 is indicated. Paper sheet material 412*a* may be any paper stock compatible with the adhesive materials selected for use on the first and second coverings 454, 456, while sheet material 412*b* is preferably one of the aforementioned materials suitable for laser printing. The pressure sensitive, adhesive backed third covering 458 if used, might be a high density polyethylene or polypropylene 4 mils thick, low tack pressure sensitive adhesive, self-wound, packaging film available from any of a number of tape suppliers including Consolidated Graphic Materials of Somerset, N.J., Flexcon Co., Inc. of Spencer, Mass or Tape Rite of New Hyde Park, N.Y.

It will be recognized by those skilled in the art that other changes can be made to the above-described embodiment disclosed and suggested without departing from the broad, inventive concepts thereof. For example, each of the variable data field sets may include only two variable data fields printed on opposing sides of a core by a duplex printer. Each cut sheet section would therefore have only one variable data field on either of its two sides. More than one variable data field per set can be provided on either or both sides of the core. However, all variable data fields of the one set would be printed on one or both sides of the sheet section in a fashion similar in concept to the other previously described embodiments of the invention. While single ply cores are preferred for cost and simplicity in most uses, multiple plies might be used for various reasons. It will further be appreciated that in most cases, it is only necessary that the unique code be identified with a unique name or unique name and address as, in some instances, it may be desirable to assign multiple unique codes to one person or entity. It should be understood, therefore, that this invention is not limited to the particular embodiments disclosed, but is intended to cover any modifications which are within the scope and spirit of the invention as defined by the appended claims.

I claim:

1. A card mailer comprising:

a generally rectangular envelope having a length and a width and a front face with a window; and an integral card/insert sheet section having a length and a width sufficient so that the sheet section is received in the envelope without folding and substantially without movement, the sheet section including a core, the core being printed in a first data field with a unique code in a machine readable format and in a second, separate data field with a name and mailing address of an individual assigned the unique code, the second data field being located on the sheet section aligned with and visible through the window of the envelope, the sheet section including an at least generally U-shaped scoring which scoring cuts at least sufficiently through the sheet section to define a generally rectangular card element removable from a remainder of the sheet section, the removable card element including at least the first data field with the unique code, the removable card element having a given material composition and the remainder of the sheet section immediately adjoining the scoring having a material composition identical to the material composition of the card portion, at least one portion of the sheet section including the removable card element being of a laminate construction with a predetermined plurality of layers including the core and another portion of the sheet product including the second data field with the name and mailing address being of fewer layers than the predetermined number of layers.

2. The mailer of claim 1 wherein all of the plurality of variable data fields of all of the printed variable data field sets are printed on the first side of the core.

3. The mailer of claim 1 wherein the removable card element defined by the scoring is about two inches by about three inches in size.

4. The mailer of claim 2 wherein the removable card element defined by the scoring is about two inches by about three inches in size.

5. The mailer of claim 1 further comprising a scored closed perimeter opening through the sheet section within the one removable card element of each sheet section.

6. The mailer of claim 5 wherein the removable card element defined by the scoring is less than two inches along one side and less than three inches along another side adjoining the one side.

7. The mailer of claim 1 wherein the removable card element defined by the scoring is less than two inches along one side and less than three inches along another side adjoining the one side.

8. The mailer of claim 1 wherein each sheet section is less than four-and-one-half inches in height and ten and five-sixteenths inches in width.

9. The mailer of claim 1 wherein the other portion consists of only a single layer, which single layer is the core.

10. The mailer of claim 9 wherein the core in the removable card element has a composition different from a composition of the core bearing the second data field in the other portion of the sheet product.

11. The mailer of claim 1 wherein the core in the removable card element has a composition different from a composition of the core bearing the second data field in the other portion of the sheet product.

12. The mailer of claim 1 wherein the one portion of the product further includes at least an outer covering releasably adhered on one side of the sheet product at least partially overlapping the removable card element and wherein the outer covering at least substantially lacks any of the scoring defining the removable card element.

13. The mailer of claim 12 wherein the scoring extends in a continuous cut entirely around a closed perimeter defining the removable card element and wherein the removable card element is releasably retained in the sheet section by being releasably adhered with the outer covering.

14. A card mailer comprising:

a generally rectangular envelope having a length and a width and a front face with a window; and an integral card/insert sheet section having a length and a width sufficient for the sheet section to be received in the envelope without folding and substantially without movement, the sheet section including a core, the core being printed in a first field and in a second, separate field, the second field being printed with a name and mailing address, the second field being located on the sheet section aligned with and visible through the window of the envelope, the core including separate first and second sheets fixedly secured together generally side by side such that only the first of the first and second sheets defines a first end of the core and only the second of the first and second sheets defines a second opposing end of the core, the first sheet being of a first material and the second sheet being of a second material different from the first material, the sheet section including an at least generally U-shaped scoring, the scoring cutting at least sufficiently through the second sheet of the core of the sheet section to define a generally rectangular card element including the first printed field removable from a remainder of the sheet section.

15. The mailer of claim 14 wherein the sheet section further comprises a first outer covering fixedly secured to one side of the core at least partially overlapping each of the first and second sheets so as to fixedly secure together the first and second sheets, the first outer covering at least partially overlapping the removable card element and being cut by the scoring defining the removable card element such that part of the first outer covering forms part of the removable card element.

16. The mailer of claim 15 further comprising another outer covering releasably adhered to one side of the sheet product at least partially overlapping the removable card element and wherein the other outer covering at least substantially lacks any of the scoring defining the removable card element of the sheet section.

17. The mailer of claim 16 wherein the scoring extends in a continuous cut entirely around a closed perimeter defining the removable card element and wherein the removable card element is releasably retained in the sheet section by the other outer covering.

18. The mailer of claim 15 further comprising a second outer covering fixedly secured to an opposing side of the sheet product at least partially overlapping the second sheet and the removable card element, the second outer covering being cut by the scoring defining the removable card element such that part of the second outer covering also forms part of the removable card element.

19. The mailer of claim 18 further comprising another outer covering layer releasably adhered to one side of the sheet product at least partially overlapping the removable card element and wherein the other outer covering layer at least substantially lacks any of the scoring defining the removable card element.

20. The card mailer of claim 14 wherein the second sheet bears a separate data field with a unique code in a machine readable format, the unique code of the data field being located within the scoring defining the removable card element.

* * * * *